United States Patent [19]

Pasquini

[11] Patent Number: 4,466,355

[45] Date of Patent: Aug. 21, 1984

[54] RAILWAY TRACK TAMPING MACHINE

[75] Inventor: Sandro Pasquini, La Tour de Peilz, Switzerland

[73] Assignee: Sig Societe Industrielle Suisse, Neuhausen, Switzerland

[21] Appl. No.: 348,971

[22] Filed: Feb. 12, 1982

[30] Foreign Application Priority Data

Feb. 24, 1981 [CH] Switzerland ..... 1198/81

[51] Int. Cl.[3] ..... E01B 27/16

[52] U.S. Cl. ..... 104/12

[58] Field of Search ..... 104/7 R, 7 B, 10, 12; 29/33 J

[56] References Cited

U.S. PATENT DOCUMENTS

| | | | |
|---|---|---|---|
| 500,954 | 7/1893 | Rundquist | 29/335 J X |
| 2,051,720 | 8/1936 | Kingsbury | 29/33 J X |
| 3,292,558 | 12/1966 | Oville | 104/10 |
| 3,534,687 | 10/1970 | Plasser et al. | 104/12 |
| 4,221,169 | 9/1980 | Theurer | 104/12 |
| 4,282,815 | 8/1981 | von Beckmann | 104/12 |

FOREIGN PATENT DOCUMENTS

| | | | |
|---|---|---|---|
| 256588 | 1/1964 | Australia | 104/12 |
| 2156538 | 5/1973 | Fed. Rep. of Germany | 104/12 |
| 2737778 | 6/1978 | Fed. Rep. of Germany | 104/12 |

*Primary Examiner*—Randolph Reese

*Attorney, Agent, or Firm*—Anthony J. Casella; Gerald E. Hespos

[57] ABSTRACT

The tamping machine is equipped with tamping units having tools (4) intended to be used for tamping both on the open track and of the switch gear. These tools are mounted on a frame (7) which is mounted for vertical movement in a gantry (8) suspended from the chassis (1) of the tamping machine by a double articulation (13, 14, 15), imparting to this gantry a transverse and longitudinal pendulum mobility with respect to the track. In order to be able to adapt the length of the compacting effected by the tools (4) in their two uses, each of these tools has two interchangeable lockable work configurations, one of which is formed of a single pick (22, FIG. 2) for the tamping of the switches and the other of which is formed of two picks (21, 22, FIG. 3) juxtaposed in the transverse direction of the track, for the tamping of the open track.

2 Claims, 9 Drawing Figures

RAILWAY TRACK TAMPING MACHINE

Figures 1, 2, 3:
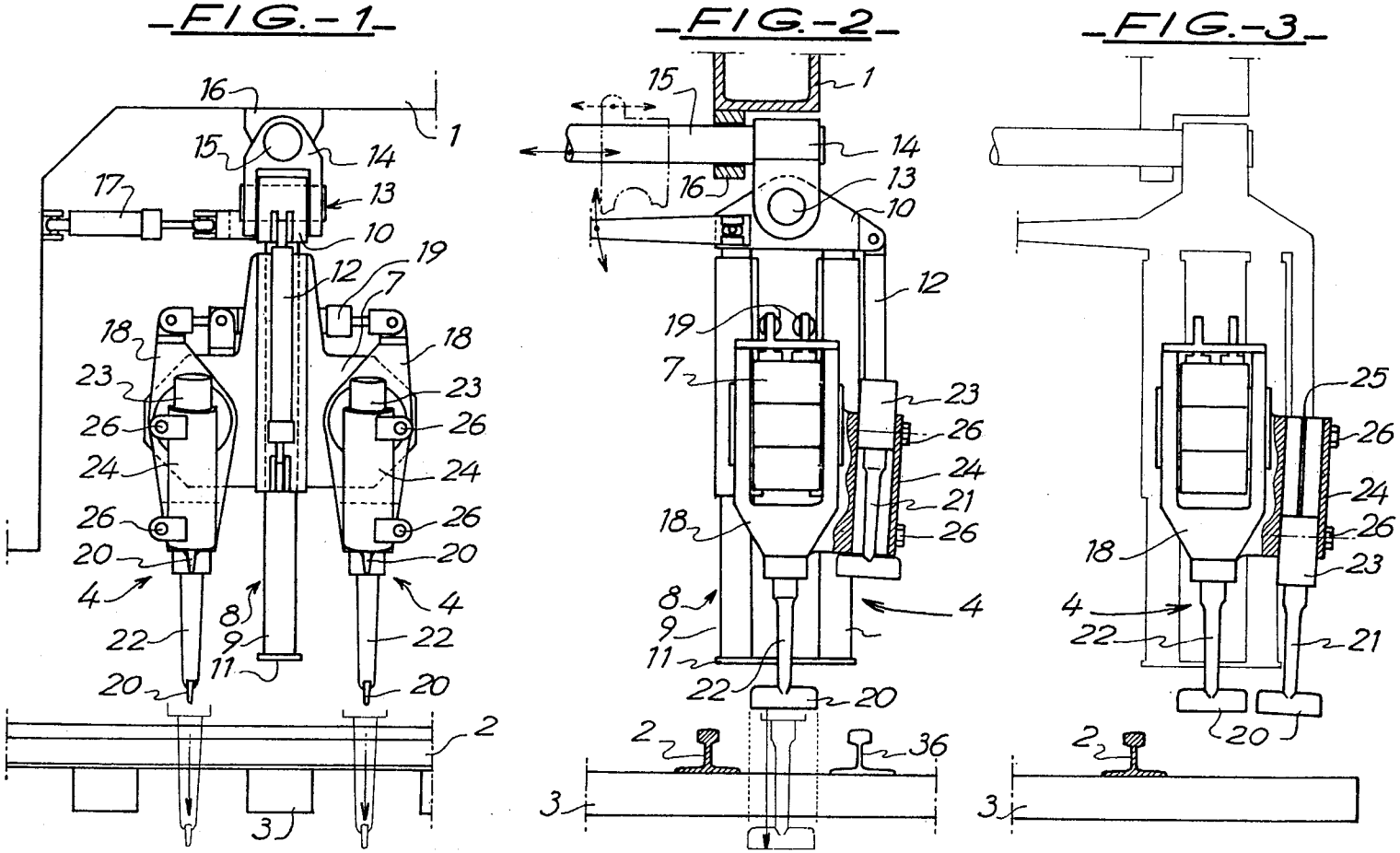

The object of the present invention is a railway track-tramping machine of the type adapted to tamp switch gear as well as the open track.

Tamping machines are already known in which the chassis is equipped for this purpose with a plurality of tamping units movable in the transverse direction of the track in order to tamp the track on either side of each line of rails as well as around the switches, and on which each of these units has at least two tamping tools which are mounted in opposition on a vertically movable carrying frame, each of which is formed by a lever which oscillates and pivots in a plane parallel to the track, and by a pick provided with an end blade of a length determined to compact the ballast below the ties and along a limited part thereof.

On these known tamping machines, the length of the blades of the picks of the tamping tools is necessarily limited to a reasonable minimum which will permit their insertion between each of the two rails of the track moved along by the tamping machine and the lateral obstacles encountered in the switches and in their immediate environment, such as, for instance, those formed of the two lines of rails of the competitive track in a simple switch. The distance available for this insertion decreases, as a matter of fact, as the rails of the competitive track approach the rails of the track moved along by the tamping machine and the length of the blades in question determies the limit as from which the insertion is no longer possible. That is to say, therefore, the limit as from which the compacting of the ballast can no longer be effected under the ties between these competitive rails. It would therefore be advantageous to reduce this limit reducing the length of the blades of the picks to the minimum useful to assure a compacting action under the maximum number of ties between the said rails.

On the other hand, on the open track, this limitation has no longer any reason for existence in view of the absence of obstacles on the opposite sides of the two rows of rails.

As the tamping machines of the aforementioned type are intended for tamping both in the open track and around switch gear, the selection of the length of the blades of the picks of their tamping tools is thus necessarily dictated by a compromise between the two criteria of efficiency and quality to provide a sufficiently extensive compacting of the ballast upon each plunging movement of the tools below the ties in order to assure them a good seat, and as complete a compacting of the ballast as possible under the maximum number of ties bearing the switch gear.

This compromise necessarily leads to a length of the pick blades which is both too short for the open track and too long for the switches to assure each tamping tool optimal operating characteristics in these two uses.

The object of this invention is to overcome this drawback in a simple, reliable manner.

For this purpose, the tamping machine in accordance with the invention is characterized by the fact that each of its tamping tools has two interchangeable and lockable working configurations the first of which is formed of a single pick and the second of which is formed of two picks juxtaposed in the transverse direction of the track.

In this way, upon the passing of the tamping tools from the first work configuration to the second work configuration it is possible to increase the extent of the compacting effected by each of them upon tamping on the open track as compared with the optimal extent of compacting which it is desired to apply, also with each of these tools, for the tamping of the switch gear.

Another advantage inherent in this concept of the tamping tools will become evident from the following description.

The accompanying drawing shows by way of example three embodiments of the tamping unit which characterizes the tamping machine of the invention.

Figure 6:
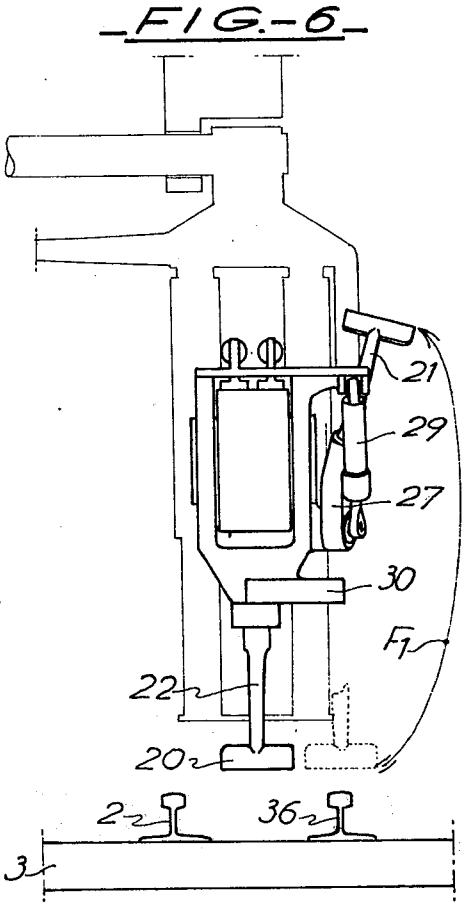
Figure 5:
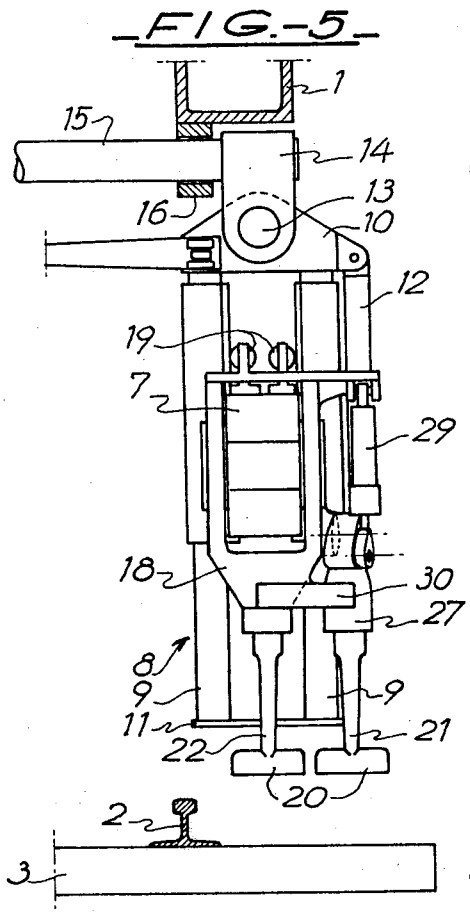
Figure 4:
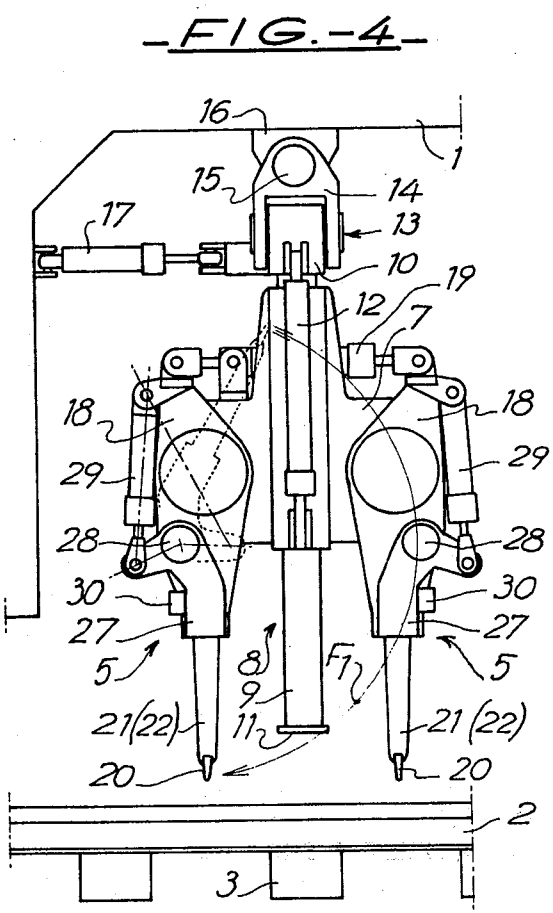
Figures 7, 8, 9:
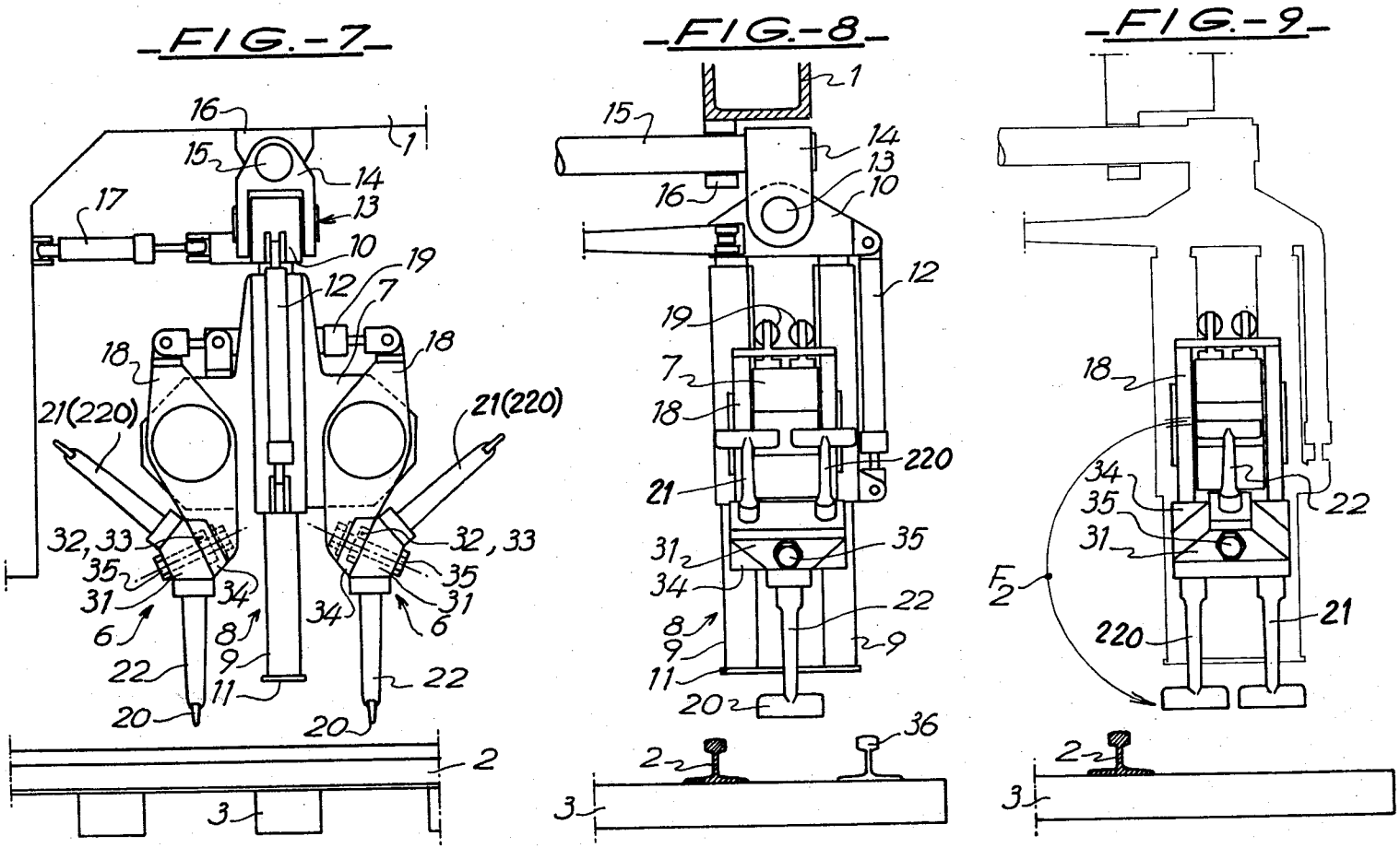

FIGS. 1, 2 and 3 are a front view and two side views respectively of the first embodiment;

FIGS. 4, 5, and 6 are a front view and two side views respectively of the second embodiment; and FIGS. 7, 8, and 9 are a front view and two side views respectively of the third embodiment.

These three embodiments have identical elements which are indicated by the same reference numbers in the figures.

The tamping unit shown is of the type adapted to tamp one side of a line of rails, and the tamping machine, of which only a part of the chassis 1 is shown, has four tamping units arranged in pairs above the two lines of rails, only one of which, marked 2, is shown in the drawing, in order to assure the compacting of the ballast beneath the ties 3 of the track.

In these three embodiments, the tamping unit has two tamping tools 4, 5, and 6 respectively mounted in opposition on a carrying frame 7 which in its turn is mounted for vertical movement in a gantry 8. This gantry is formed of two parallel columns 9 connected at their ends by an upper cross member 10 and a lower cross member 11. The carrying frame 7 slides along two columns 9 and its movements are controlled by a hydraulic piston-cylinder unit 12 resting against the upper cross member 10. The gantry 8 is connected to the chassis 1 of the tamping machine by a suspension system comprising a double articulation 13–14 imparting to it pendulum mobility both in a plane transverse to the track and in a plane parallel to it, and a shaft 15 which slides in the transverse direction of the track and is supported by two bearing brackets fastened to the chassis 1, only one of which (16) is visible in these figures, the said shaft 15 supporting the double articulation 13–14. This system of suspending the tamping unit is intended to permit transverse and longitudinal evasion of the obstacles created by the switch gear and it has driving piston-cylinder units connected to the chassis 1, only one of which, the unit 17, is shown in order not to needlessly clutter the drawing.

The tools 4, 5, and 6 of these three embodiments of the tamping unit are each formed by a lever 18 which oscillates and is pivoted in a plane parallel to the track and is articulated on the carrying frame 7; the latter is in this case in the form of a housing containing the mechanism for the oscillating of the said tools. The pivoting of the two levers 18 articulated on the carrying frame 8, which is intended to assure the closing of the two tamping tools around each tie 3 of the track, is controlled by two hydraulic piston-cylinder units 19 which rest on the said carrying frame between the two columns 9 of the gantry 8.

In these three embodiments the tamping tools comprise picks provided with end blades 20 of a length determined in such a manner as to compact the ballast below the ties, which length will be referred to further below.

In accordance with the teaching of the invention these tools have two interchangeable lockable work configurations the first of which is formed of a single pick while the second is formed of two picks juxtaposed in the transvere direction of the track.

In the first embodiment, shown in FIGS. 1, 2 and 3, each tamping tool 4 comprises a first pick 21 rigidly fastened to a cylindrical arm 23 mounted for sliding in a sleeve 24 which is rigidly fastened on the lever 18, and a second pick 22 fastened directly and rigidly on the said lever 18 in working position. The sleeve 24 has a longitudinal slot 25, visible in FIG. 3, and two tangential clamping screws 26. The translation of the movable arm 23 within this sleeve is limited by means of these two clamping screws 26 in two end-of-stroke positions which can be locked and one of which, shown in FIGS. 1 and 2, corresponds to a non-operating position of the pick 21 while the other, shown in FIG. 3, corresponds to the working position of this same pick 21. In this working position the two picks 21 and 22 are juxtaposed in the transverse direction of the track. The change from one position to the other is effected here manually.

In the second embodiment, shown in FIGS. 4, 5, and 6, each tamping tool 5 has a first pick 21 which is rigidly fastened to an arm 27 which is pivotally mounted on a trunnion 28 rigidly attached to the lever 18 and a second pick 22 fastened directly and rigidly on this same lever 18 in work position. The pivoting of the arm 27 is obtained by means of a double-acting hydraulic piston-cylinder unit 29 serving as connecting rod and this pivoting is limited by two lockable end-of-stroke positions one of which, shown in FIGS. 4 and 5, corresponds to the working position while the other, shown in FIG. 6, as well as in dashed lines in FIG. 4, corresponds to a non-operating position of the pick 21. In working position the locking is obtained by means of an end-of-stroke stop 30 rigidly fastened to the lever 18 and by the maintaining of the pressure in the lower chamber of the piston-cylinder unit 29. In non-working position, the locking is obtained either by the striking of the piston of the piston-cylinder unit 29 against the bottom of the upper chamber of said cylinder, the pressure being also maintained in its lower chamber, or by a second stop fastened to the lever 18. In its working position, the first pick 21 is adjacent the second pick 22 in the transverse direction of the track. The plane of pivoting of the movable arm 27 and of its pick 21 is oblique with respect to that of the carrying frame 7 in order to prevent these two elements of each tool coming against homologous elements of the other tools as well as of the piston-cylinder unit 12 during their pivoting movement indicated in FIGS. 4 and 6 by the arrow $F_1$, but this obliqueness is not indispensable and may be eliminated when no obstacle interferes with this pivoting movement.

In the third embodiment, shown in FIGS. 7, 8, and 9, each tamping tool 6 comprises, mounted radially and rigidly on a rotary turret 31 and in two different angular positions, here equal to 180°, on the one hand a single pick 22 and on the other hand two juxtaposed picks forming a pair 21-220. The turret 31 is mounted for rotation in a plane transverse to the railway track on the lever 18 of this tamping tool and comprises for this purpose a trunnion 32 engaged in a cylindrical counterbore 33 of a base 34 which is rigidly fastened to the said lever 18 and this turret 31 is maintained against said base by an axial clamping bolt 35. By the blocking of this bolt 35, the turret 31 is locked against the base 34 either in the working position of the single pick 22, in which case the pair of picks 21-220 is of course in non-working position as shown in FIG. 8, or in the working position of the said pair 21-220, in which case the single pick 22 is, of course, in non-working position as shown in FIG. 9. The passage from one position to the other is effected here manually by rotation of the turret-pick unit by 180° in the direction indicated by the arrow $F_2$. The angular distance between the single pick 22 and the pair of picks 21-220 may be less than 180° to the extent that, in the non-working position during the tamping, these elements are located above the line of rails and do not interfere with the tamping unit which is working on the other side of the said line.

In the three embodiments shown, the blades 20 of the picks are of the same length so that the extent of the compacting which can be effected in the second two-pick configuration of the tamping tools is substantially twice that which can be effected in the first single-pick configuration.

However, this choice is not limitative and this is an additional advantage offered by the invention of being able to make the length of the blades of the picks 21 and 220 constituting the second configuration different.

One can thus satisfy both the two basic extents of optimum compacting desired, corresponding to what is desirable for the open track and what is desirable for the switch gear, by effecting this differentiation.

Thus in FIGS. 2, 6 and 8 the length of the blade of the pick 22 which is intended to compact the ballast below the tie 3 between a line of rails 2 of the track followed by the tamping machine and a competitive line of rails 36 of a simple switch can be selected in full freedom, regardless of the length of the blade of the pick 21 which in its turn will then be determined by simple subtraction of this selected length from the total of the two lengths of these two blades, this total corresponding to the second selected value of the compacting desired for the open track.

Finally, the translation of the pick arms 23 of the tools 4 of the first embodiment shown, FIGS. 1 to 3, and the pivoting of the turret 31 of the tools of the third embodiment, shown in FIGS. 7 to 9, as well as the blocking of the ends of stroke of these elements can be mechanized without going beyond the scope of the invention, in the same manner as the rotation fo the pick arms 27 of the second embodiment shown in FIGS. 4 to 6 has been shown mechanized, but this mechanization is not indispensable for the purpose sought.

What is claimed is:

1. A railway track tamping machine for tamping switches as well as open track, comprising in combination:

(a) a rolling chassis;

(b) a plurality of tamping units mounted on said rolling chassis, said tamping units being displaceable in a direction transverse to the elongation of the track to tamp the track on either side of each line of rails as well as to avoid lateral obstacles upon tamping of track switches;

(c) a tool carrying frame mounted for vertical movement in each of said tamping units;

(d) two levers mounted in opposition on said tool carrying frame, said levers being articulated on the tool carrying frame for oscillating and pivotal movement in a plane parallel to the direction of elongation of the track;

(e) first and second tamping picks mounted on each of said two levers, said first and second tamping picks forming with their respective lever one tamping tool located on one side of a line of rails;

(f) means for fixedly fastening each of said first tamping picks on the levers in a downward work condition;

(g) means for moving each of said second tamping picks on the levers between a first lowered position in which said second tamping pick is in a downward work condition adjacent to said first tamping pick with respect to the direction transverse to the elongation of the track and a second raised position in which said second tamping pick is not in a work condition; and (h) means for immobilizing said second tamping picks in each of said first and second positions.

2. A railway track tamping machine for tamping switches as well as open track, comprising in combination:

(a) a rolling chassis;

(b) a plurality of tamping units mounted on said rolling chassis, said tamping units being displaceable in a direction transverse to the elongation of the track to tamp the track on either side of each line of rails as well as to avoid lateral obstacles upon tamping of track switches;

(c) a tool carrying frame mounted for vertical movement in each of said tamping units;

(d) two levers mounted in opposition on said tool carrying frame, said levers being articulated on the tool carrying frame for oscillating and pivotal movement in a plane parallel to the direction of elongation of the track;

(e) turret means mounted on each of said two levers for rotation in a plane transverse to the direction of elongation of the track;

(f) first, second and third tamping picks mounted on each of said turret means, said first, second and third tamping picks forming with their respective turret means and lever one tamping tool located on one side of a line of rails;

(g) means for fixedly fastening said first tamping pick in a first radial position on the turret means;

(h) means for fixedly fastening said second and third tamping picks on the turret means in a second radial position in which said second and third tamping picks are adjacent to each other in a plane transverse to the direction of elongation of the track, said second radial position being angularly different from said first radial position; and (i) means for immobilizing said turret means on the lever in a first position in which said first tamping pick is in a downward work condition, and in a second position in which said second and third tamping picks are in a downward work condition.

* * * * *